US009828996B2

(12) United States Patent
Tsuchida et al.

(10) Patent No.: US 9,828,996 B2
(45) Date of Patent: Nov. 28, 2017

(54) HERMETIC ROTARY COMPRESSOR

(71) Applicants: Kazuchika Tsuchida, Tokyo (JP); Osamu Kazama, Tokyo (JP)

(72) Inventors: Kazuchika Tsuchida, Tokyo (JP); Osamu Kazama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 247 days.

(21) Appl. No.: 14/653,041

(22) PCT Filed: Dec. 20, 2012

(86) PCT No.: PCT/JP2012/083098
§ 371 (c)(1),
(2) Date: Jun. 17, 2015

(87) PCT Pub. No.: WO2014/097453
PCT Pub. Date: Jun. 26, 2014

(65) Prior Publication Data

US 2015/0330382 A1 Nov. 19, 2015

(51) Int. Cl.
*F04C 23/02* (2006.01)
*F04C 29/00* (2006.01)
(Continued)

(52) U.S. Cl.
CPC ..... *F04C 23/02* (2013.01); *F04B 39/0094* (2013.01); *F04B 39/023* (2013.01);
(Continued)

(58) Field of Classification Search
CPC ..... F04C 29/023; F04C 29/0021; F04C 2240/807; F04C 23/02; F04C 23/008;
(Continued)

(56) References Cited

U.S. PATENT DOCUMENTS 5,222,885 A * 6/1993 Cooksey ..... F04C 29/023 418/94
5,533,875 A * 7/1996 Crum ..... F04C 23/008 417/368

(Continued)

FOREIGN PATENT DOCUMENTS

JP 49-133204 U 11/1974
JP 63-58872 U 4/1988

(Continued)

OTHER PUBLICATIONS

International Search Report of the International Searching Authority dated Apr. 2, 2013 for the corresponding international application No. PCT/JP2012/083098 (and English translation).

*Primary Examiner* — Mark Laurenzi
*Assistant Examiner* — Xiaoting Hu
(74) *Attorney, Agent, or Firm* — Posz Law Group, PLC

(57) ABSTRACT

A rotor has at its two axis end portions an upper large-diameter inner circumferential portion and a lower large-diameter inner circumferential portion that have inner diameters larger than the inner diameter of the axially middle portion of the rotor and are offset in the radial direction. A crankshaft has a passageway, which is formed in the crankshaft and allows refrigerant to flow therethrough, and a gas venting hole, which provides communication between the passageway and at least one discharge opening formed in the outer circumferential surface of the crankshaft. The at least one discharge opening is formed at a position facing the inner circumferential surface of the lower large-diameter inner circumferential portion 5*b* on the compression unit side.

3 Claims, 6 Drawing Sheets

(51) Int. Cl.

| | |
|---|---|
| ***F04B 39/00*** | (2006.01) |
| ***F04C 15/06*** | (2006.01) |
| ***F04C 15/00*** | (2006.01) |
| ***F04C 23/00*** | (2006.01) |
| ***F04C 29/02*** | (2006.01) |
| ***F04B 39/02*** | (2006.01) |
| ***F04B 39/04*** | (2006.01) |

(52) U.S. Cl.
CPC ..... *F04B 39/0246* (2013.01); *F04B 39/04* (2013.01); *F04C 15/0088* (2013.01); *F04C 15/06* (2013.01); *F04C 23/008* (2013.01); *F04C 29/0021* (2013.01); *F04C 29/023* (2013.01); *F04C 2240/807* (2013.01)

(58) Field of Classification Search
CPC .. F04C 18/0215; F04C 15/0042; F04C 15/06; F04C 15/0088; F04C 29/02; F04C 29/025; F04C 29/045; F04B 39/0055; F04B 39/0094; F04B 39/023–39/0253; F16F 15/28
USPC ..... 418/151, 188, 88, 91, 94, 97, 99, 100; 417/410.5
See application file for complete search history.

(56) References Cited

U.S. PATENT DOCUMENTS

| | | | | |
|---|---|---|---|---|
| 6,000,917 | A * | 12/1999 | Smerud | F04C 23/008 417/366 |
| 6,305,914 | B1 * | 10/2001 | Lifson | F04C 29/0021 417/410.5 |
| 2004/0042917 | A1 * | 3/2004 | Chang, II | F04C 23/008 417/410.5 |
| 2008/0078618 | A1 * | 4/2008 | Lee | F04C 18/356 184/6.2 |
| 2008/0175738 | A1 * | 7/2008 | Jung | F04C 18/0215 418/55.6 |
| 2008/0226483 | A1 * | 9/2008 | Iwanami | F01C 21/10 418/97 |
| 2009/0041603 | A1 * | 2/2009 | Ginies | F04C 18/0215 418/55.6 |
| 2012/0107151 | A1 * | 5/2012 | Yokoyama | F04B 39/16 417/366 |

FOREIGN PATENT DOCUMENTS

| | | | |
|---|---|---|---|
| JP | 01-152935 | A | 6/1989 |
| JP | 05-316672 | A | 11/1993 |
| JP | 2000-213483 | A | 8/2000 |
| JP | 2001-349284 | A | 12/2001 |
| JP | 2002-089476 | A | 3/2002 |

* cited by examiner

HERMETIC ROTARY COMPRESSOR

CROSS REFERENCE TO RELATED APPLICATION

This application is a U.S. national stage application of International Patent Application No. PCT/JP2012/083098 filed on Dec. 20, 2012.

TECHNICAL FIELD

The present invention relates to a hermetic rotary compressor.

BACKGROUND

Hermetic rotary compressors include, as main components, a hermetic container, an electric motor provided in the hermetic container, and a compression unit arranged in the hermetic container and driven by the electric motor to compress refrigerant gas. The electric motor includes a rotor firmly fixed on a crankshaft extending from a rocking scroll in the compression unit and a stator fixed to the hermetic container. Such a hermetic rotary compressor sucks the refrigerant gas into the compression unit and compresses the refrigerant gas by rotating the rotor to rotate the crankshaft and thereby rotates the rocking scroll provided on the crankshaft. The compressed refrigerant gas is discharged into the hermetic container to pass through the gap between the hermetic container and the stator and the gap between the rotor and the stator and is supplied through a discharge pipe to a refrigerator. Meanwhile, lubricating oil stored in the hermetic container is raised in a passageway in the crankshaft by the pressure-feeding action of an oil stirrer (twisted plate) provided in the passageway during the rotation of the crankshaft and supplied as a sealing oil and a lubricating oil to sliding portions of the compression unit and the like.

A hermetic rotary compressor having such a configuration causes deformation in the crankshaft because the torque increases when the refrigerant is compressed and the torque decreases when the high pressure refrigerant is discharged. The deformation in the crankshaft results from the load that the crankshaft receives from the rocking scroll and is increased during the rotation at higher speeds and under higher loads. As a result, vibrations and noises are generated.

To mitigate such vibrations and noises, conventional hermetic rotary compressors typically include components called balance weights attached on the axial ends of the rotor. Here, the balance weights are desirably made of a material that has a high specific gravity and allows no magnetic flux from the rotor to pass therethrough (low magnetic permeability), and brass is typically used. The brass is, however, expensive and it is desirable not to use the brass to reduce costs.

To dispense with the balance weights, a conventional rotor described in Patent Literature 1 has a through-opening, which is unbalanced with respect to the shaft hole as the center, in at least one axial end of the rotor. This configuration in the conventional technique described in Patent Literature 1 allows the rotor to produce the effect of the balance weights.

Patent Literature

Patent Literature 1: Japanese Patent Application Laid-Open No. 10-152935

An unbalanced through-opening in the inner side of the rotor surface, as in the conventional technique described in Patent Literature 1, however, is less effective in cancelling the vibration (that is, the effect of cancelling the deforming force of the crankshaft acting when the compression unit compresses the refrigerant) in comparison with the case when the balance weights are used, and thus requires larger force to cancel the vibration. As described above, the conventional technique is problematic in that it cannot reduce costs and cannot produce the vibration mitigating effect at a similar level to the case with the balance weights.

SUMMARY

The present invention has been achieved in view of the above, and an object of the present invention is to provide a hermetic rotary compressor that provides the capability of reducing costs and mitigating vibration.

To solve the above described problems and achieve the object, a hermetic rotary compressor according to the present invention includes: a compression unit that compresses refrigerant gas; an electric motor that drives the compression unit; a hermetic container that accommodates the compression unit and the electric motor and contains the refrigerant; and a crankshaft that extends from the compression unit to the electric motor and is provided on a rotor in the electric motor. The rotor has two large-diameter inner circumferential portions formed at two axis end portions of the rotor, the large-diameter inner circumferential portions having inner diameters larger than an inner diameter of an axially middle portion of the rotor, the large-diameter inner circumferential portions having inner diameter centers offset with respect to a rotation axis line of the crankshaft in a radial direction, and the crankshaft has a first passageway and a second passageway, the first passageway being formed in the crankshaft and allowing the refrigerant to flow through the first passageway, the second passageway providing communication between the first passageway and at least one discharge opening that is formed in an outer circumferential surface of the crankshaft, the at least one discharge opening being formed at a position that faces an inner circumferential surface of one of the two large-diameter inner circumferential portions, the one large-diameter inner circumferential portion being on a side of the compression unit.

The present invention makes refrigerant raised from a compression unit during the rotation to jet out onto an inner circumferential surface of inner circumferential portions formed at both axially end portions of a rotor to thereby cancel a deforming force of a shaft and, thus, achieves an effect of reducing costs and mitigating vibration.

DETAILED DESCRIPTION

Exemplary embodiments of a hermetic rotary compressor according to the present invention will now be described in detail with reference to the drawings. The present invention is not limited to the embodiments.

First Embodiment

Figure 1:
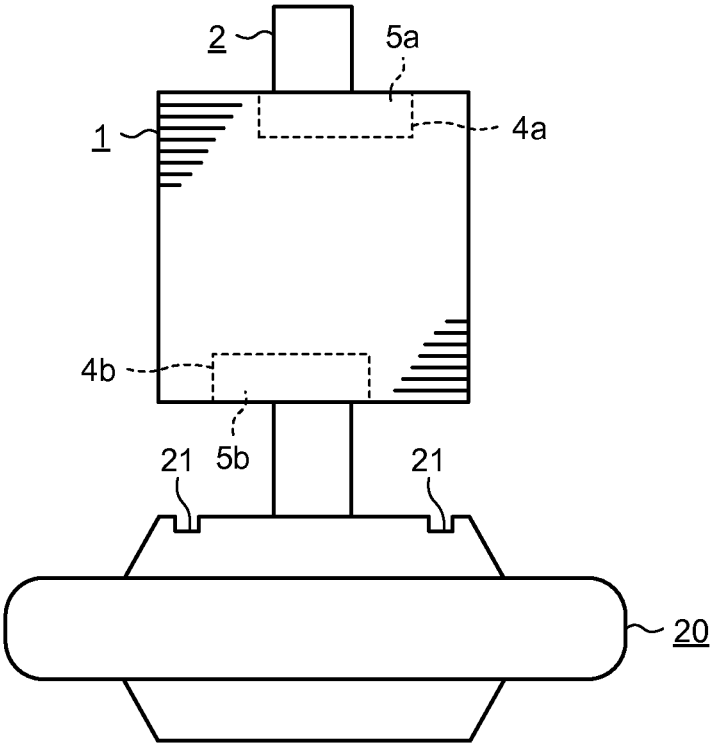
FIG. 1 is a diagram of major components of a hermetic rotary compressor according to a first embodiment of the present invention.
Figure 2:
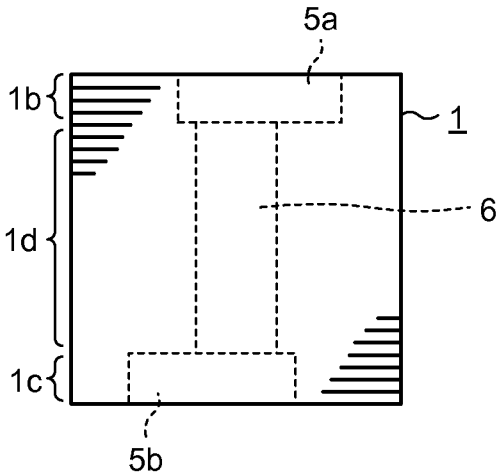
FIG. 2 is a side view of a rotor illustrated in FIG. 1.
Figure 3:
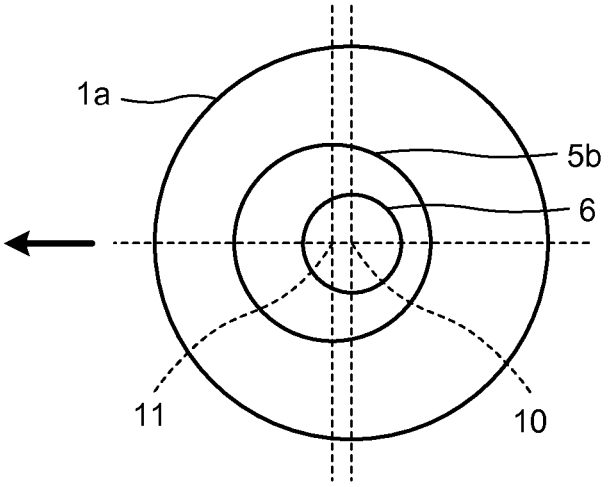
FIG. 3 is a plan view of the rotor illustrated in FIG. 1.
Figure 4:
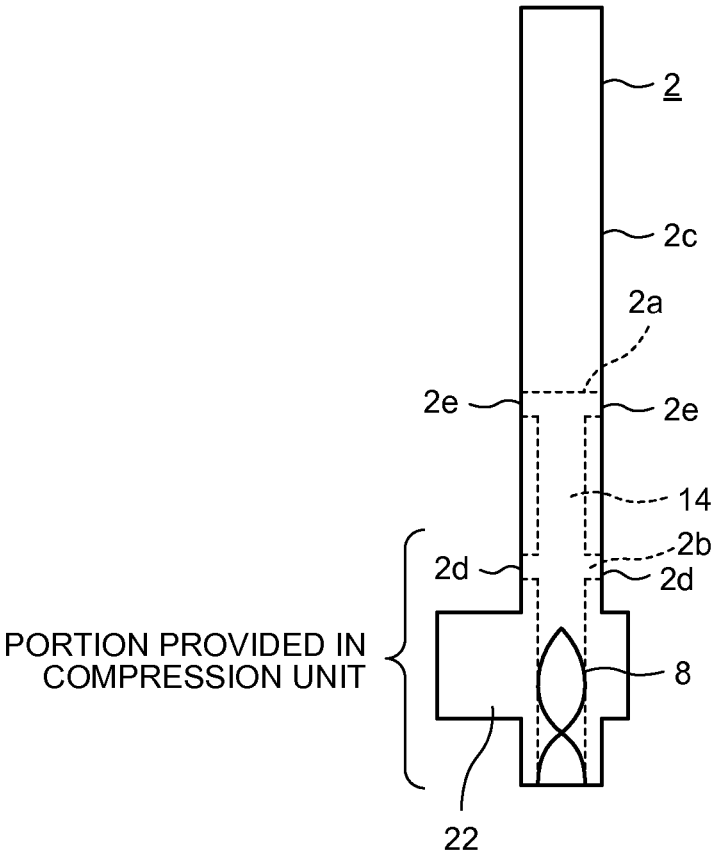
FIG. 4 is a configuration diagram of a crankshaft illustrated in FIG. 1.
Figure 5:
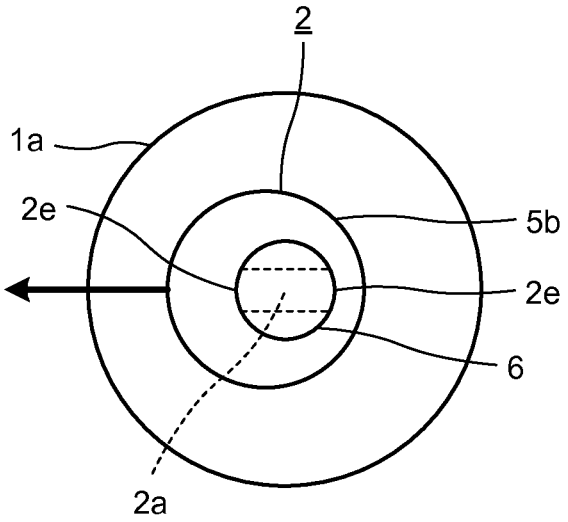
FIG. 5 is a diagram for explaining the relationship between a gas venting hole provided in the crankshaft and a large-diameter inner circumferential portion formed in the rotor.
Figure 6:
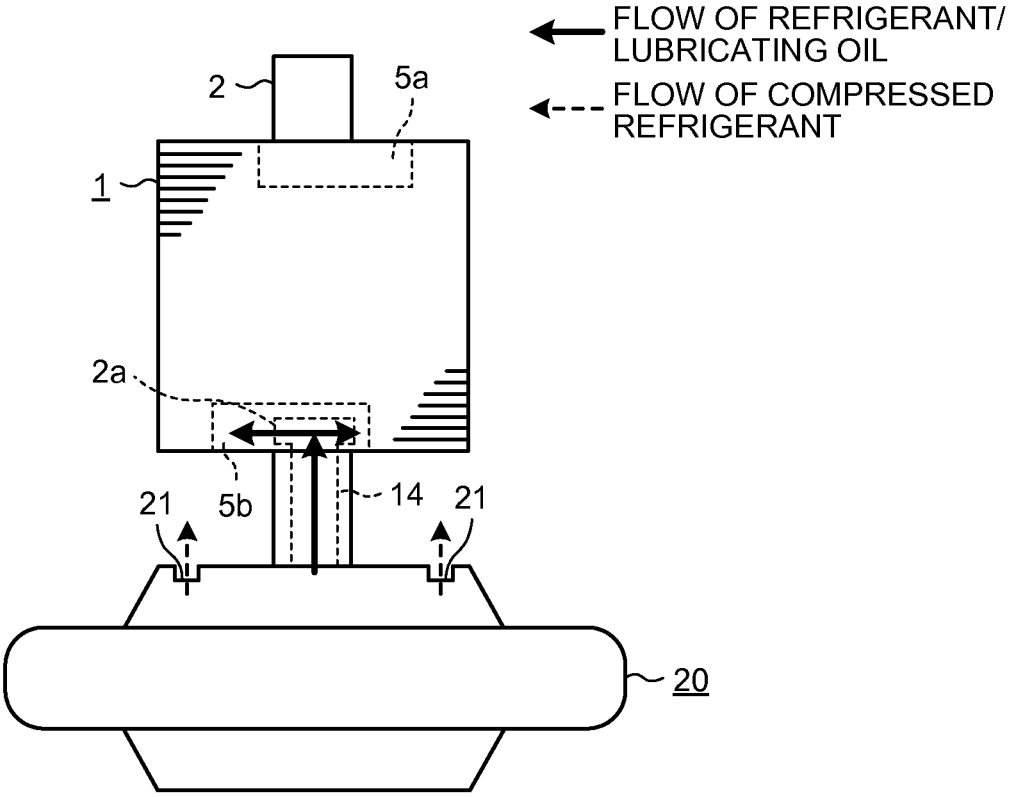
FIG. 6 is a first diagram for explaining the operation of the hermetic rotary compressor according to the first embodiment of the present invention.
Figure 7:
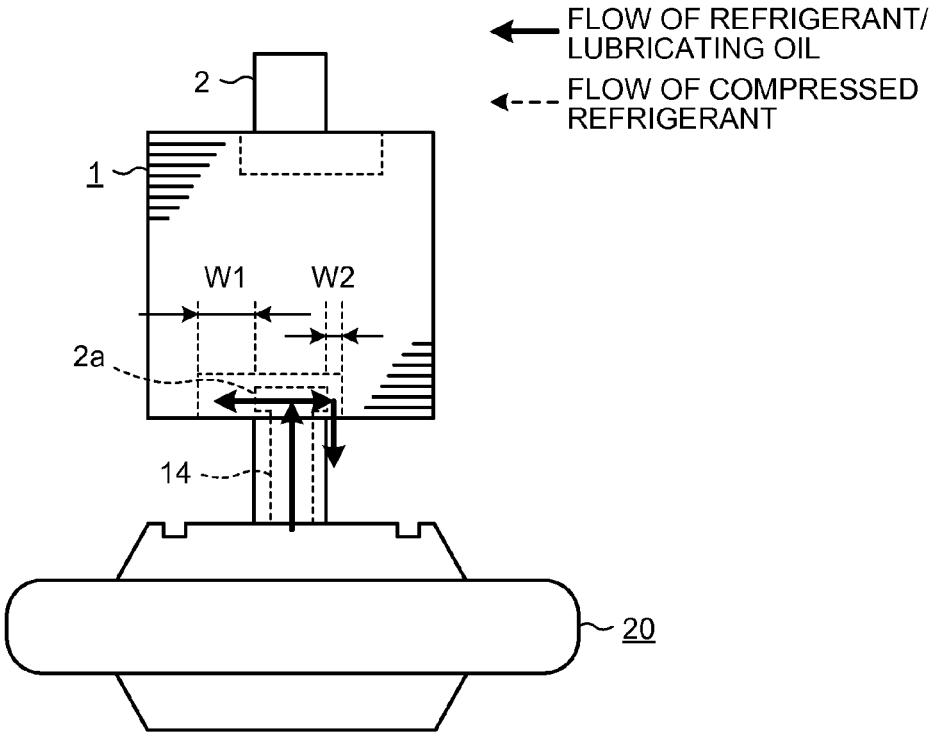
FIG. 7 is a second diagram for explaining the operation of the hermetic rotary compressor according to the first embodiment of the present invention.

FIG. 1 is a diagram of major components of a hermetic rotary compressor according to a first embodiment of the present invention. FIG. 2 is a side view of a rotor illustrated in FIG. 1. FIG. 3 is a plan view of the rotor illustrated in FIG. 1. FIG. 4 is a configuration diagram of a crankshaft illustrated in FIG. 1. FIG. 5 is a diagram for explaining the relationship between a gas venting hole provided in the crankshaft and a large-diameter inner circumferential portion formed in the rotor. FIG. 6 is a first diagram for explaining the operation of the hermetic rotary compressor according to the first embodiment of the present invention. FIG. 7 is a second diagram for explaining the operation of the hermetic rotary compressor according to the first embodiment of the present invention.

In FIG. 1, a compression unit 20 and a rotor 1 are illustrated as major components of the hermetic rotary compressor. The compression unit 20 is provided in a hermetic container (not illustrated) containing lubricating oil and compresses refrigerant gas. The rotor 1 is firmly fixed on a crankshaft 2 extending from the compression unit 20. The rotor 1 includes a permanent magnet and a laminated core and is arranged on the inner diameter side of an undepicted stator. The crankshaft 2 rotates together with the rotor 1, and a rocking scroll 22 provided in the compression unit 20 is attached to the crankshaft 2 at its lower portion. The crankshaft 2 will be described in detail later.

With reference to FIG. 2, the rotor 1 has a small-diameter inner circumferential portion 6, an upper large-diameter inner circumferential portion 5*a*, and a lower large-diameter inner circumferential portion 5*b* formed on the inner diameter side of the rotor 1. The small-diameter inner circumferential portion 6 is formed at an axially middle portion (axis middle portion 1*d*) of the rotor 1 and has an inner diameter substantially identical with the outer diameter of the crankshaft 2. The upper large-diameter inner circumferential portion 5*a* is formed at an end (upper axis end portion 1*b*) of the rotor 1 on the opposite side to the compression unit 20. The lower large-diameter inner circumferential portion 5*b* is formed at an end (lower axis end portion 1*c*) of the rotor 1 on the compression unit 20 side.

FIG. 3 is a view of the lower large-diameter inner circumferential portion 5*b* and the small-diameter inner circumferential portion 6, with the rotor 1 observed from the compression unit 20 side. In the illustrated example, the upper large-diameter inner circumferential portion 5*a* is omitted. In this manner, the upper large-diameter inner circumferential portion 5*a* and the lower large-diameter inner circumferential portion 5*b* have inner diameters larger than the inner diameter of the small-diameter inner circumferential portion 6, with their centers 11 offset with respect to a rotation axis line 10 in a radial direction, such that the weight balance of the rotor 1 achieves an imbalance.

With reference to FIG. 4, the crankshaft 2 has a passageway 14 for the refrigerant and the lubricating oil (hereinafter referred to as "refrigerant and the like"), extending upward from the lower end of the crankshaft 2. An oil stirrer 8 is provided in the passageway 14 at its lower portion to pressure-feed the lubricating oil, which is stored in the hermetic container at its lower portion, upward through the passageway 14. The crankshaft 2 also has an oil supply hole 2*b* and a gas venting hole 2*a* positioned above the oil supply hole 2*b*.

The oil supply hole 2*b* is formed above the rocking scroll 22 to provide communication between an outer circumferential surface 2*c* of the crankshaft 2 and the passageway 14, and has discharge openings 2*d*, which are on the outer circumferential surface 2*c* side, positioned inside the compression unit 20. When the crankshaft 2 rotates, the lubricating oil contained in the hermetic container is pressure-fed by the pressure-feeding action of the oil stirrer 8 upward from the lower end of the passageway 14. The lubricating oil is, then, discharged from the oil supply hole 2*b* positioned inside the compression unit 20 to be supplied to the compression unit 20 and other sliding portions. This maintains the airtightness of each sliding portion and produces the lubricating action.

The gas venting hole 2*a* is formed such that it penetrates through the crankshaft 2 and communicates with the passageway 14. The gas venting hole 2*a* has discharge openings 2*e* in the outer circumferential surface 2*c* of the crankshaft 2. The discharge openings 2*e* are formed in such a manner to face an inner circumferential surface 4*b* of the lower large-diameter inner circumferential portion 5*b* of the rotor 1.

FIG. 5 is a view illustrating the relationship between the lower large-diameter inner circumferential portion 5*b* and the gas venting hole 2*a*, when the rotor 1 is viewed from the compression unit 20 side. As described above, the lower large-diameter inner circumferential portion 5*b* has the center 11 offset with respect to the rotation axis line 10 in the radial direction (see FIG. 3). The gas venting hole 2*a* has the discharge openings 2*e* in the outer circumferential surface 2*c* of the crankshaft 2 in the direction in which the lower large-diameter inner circumferential portion 5*b* is offset (the direction indicated by the arrow) and in the direction opposite to the arrow.

The operation of the hermetic rotary compressor according to the first embodiment will now be described with reference to FIG. 6. FIG. 6 is a first diagram for explaining the operation of the hermetic rotary compressor according to the first embodiment of the present invention. The rotor 1 rotates to compress the refrigerant in the compression unit 20 via the crankshaft 2. The compressed high pressure refrigerant is discharged from discharge pipes (not illustrated) provided in the upper surface of the compression unit. Meanwhile, the lubricating oil staying at a lower portion of the compression unit 20 is raised by the oil stirrer 8 through the passageway 14 and discharged from the oil supply hole 2*b*. Thus, problems such as seizure due to friction of the compression unit 20 are prevented from occurring.

Meanwhile, the refrigerant and the like that passes through the passageway 14 is discharged from the gas venting hole 2*a*. Here, when the refrigerant and the like that is pressure-fed through the passageway 14 is discharged from the discharge openings 2*e* of the gas venting hole 2*a*, a centrifugal force due to the rotation of the crankshaft 2 acts on the refrigerant and the like. The discharge openings 2*e* of the gas venting hole 2*a* are formed at the positions facing the inner circumferential surface 4*b* of the lower large-diameter inner circumferential portion 5*b* of the rotor 1. Hence, the refrigerant and the like under the influence of the centrifugal force collides with the inner circumferential surface 4*b* of the lower large-diameter inner circumferential portion 5*b*.

Since the rotor 1 according to the present embodiment has the inner circumferential portions (5*a* and 5*b*) formed at the axis end portions (1*b* and 1*c*) such that the weight balance achieves an imbalance, the deforming force of the crankshaft 2 acting when the compression unit 20 compresses the refrigerant can be cancelled. Thus, the vibrations and noises can be reduced.

In the rotor 1 according to the present embodiment, the discharge openings 2*e* of the gas venting hole 2*a* are provided in the direction in which the lower large-diameter inner circumferential portion 5*b* is offset and in the opposite direction. Hence, as illustrated in FIG. 7, a clearance W1 between the inner circumferential surface 4*b* of the lower large-diameter inner circumferential portion 5*b* and one of the discharge openings 2*e* is wider than a clearance W2 between the inner circumferential surface 4*b* of the lower large-diameter inner circumferential portion 5*b* and one of the other discharge openings 2*e*.

Because of this configuration, the refrigerant and the like discharged from the discharge opening 2*e* on the clearance W2 side hits the inner circumferential surface 4*b* of the lower large-diameter inner circumferential portion 5*b* before falling toward the compression unit 20, while the refrigerant and the like discharged from the discharge opening 2*e* on the clearance W1 side does not hit the inner circumferential surface 4*b* of the lower large-diameter inner circumferential portion 5*b*. Thus, as the refrigerant and the like under the influence of the centrifugal force of the crankshaft 2 hits the inner circumferential surface 4*b* of the lower large-diameter inner circumferential portion 5*b*, its jetting force acts as a force to decenter the crankshaft 2. As a result, a further mitigating effect on the vibrations and noises can be expected.

When the rotor 1 rotates at high speeds, the lubricating oil discharged from the discharge opening 2*e* at the clearance W1 side hits the inner circumferential surface 4*b* of the lower large-diameter inner circumferential portion 5*b* before falling toward the compression unit 20. If the lubricating oil scatters beyond the inner circumferential surface 4*b* to the outer circumferential side without hitting the inner circumferential surface 4*b* of the lower large-diameter inner circumferential portion 5*b*, discharge holes 21 formed in the upper portion of the compression unit 20 may be blocked by the lubricating oil. If the discharge holes 21 are blocked by the lubricating oil, the refrigerant, which is compressed to have high pressure, may be discharged from the discharge holes 21 with difficulty; thus, degradation in performance of the compressor may result. In the rotor 1 according to the present embodiment, the discharge openings 2*e* of the gas venting hole 2*a* face the inner circumferential surface 4*b* of the lower large-diameter inner circumferential portion 5*b* of the rotor 1. This provides the capability of preventing the lubricating oil discharged from the gas venting hole 2*a* from scattering beyond the inner circumferential surface 4*b* of the lower large-diameter inner circumferential portion 5*b* to the outer circumferential side. Hence, even in a case where the discharge holes 21 of the compression unit 20 are provided at the positions as illustrated in FIG. 7 (on the radially outer side of the inner circumferential surface 4*b* of the lower large-diameter inner circumferential portion 5*b*), there is no potential for the discharge holes 21 to be blocked by the lubricating oil.

Figure 9:
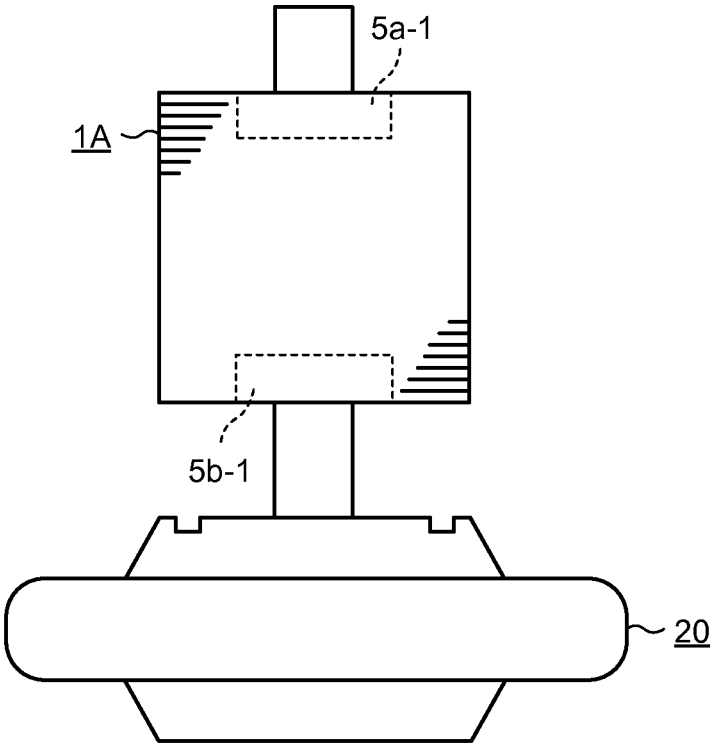
FIG. 9 is a diagram illustrating the internal model of a typical compressor.

FIG. 9 is a diagram illustrating the internal model of an ordinary compressor. In a rotor 1A configured as illustrated in FIG. 9, the inner diameters of an upper large-diameter inner circumferential portion 5*a*-1 and a lower large-diameter inner circumferential portion 5*b*-1 are not offset in the radial direction. A compressor having such a configuration experiences torque fluctuations because the torque increases when the refrigerant is compressed and the torque decreases when the high pressure refrigerant is discharged and, as a result, the vibrations and noises are generated.

Figure 10:
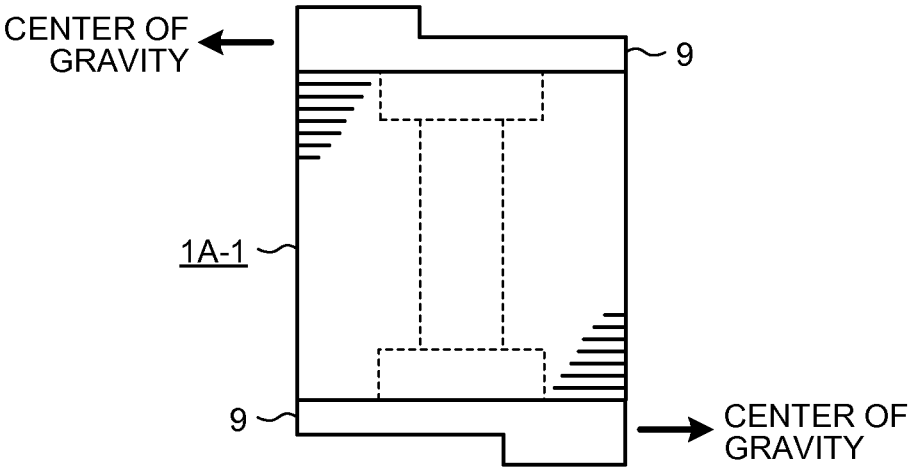
FIG. 10 is a diagram of a rotor configured such that the issue found with a rotor illustrated in FIG. 9 is solved.

FIG. 10 is a diagram of a rotor 1A-1 configured such that the problems shown by the rotor illustrated in FIG. 9 are solved. To mitigate the vibrations and noises, components called balance weights 9 are typically attached to the axial ends of the rotor 1A-1, as illustrated in FIG. 10. The balance weights 9 are formed to have unbalanced centers of gravity and attached in orientations to cancel deformation in a crankshaft caused when refrigerant is compressed. This cancels the deformation in the crankshaft caused when the refrigerant is compressed, so that the vibrations and noises can be mitigated. Here, the balance weights are desirably made of a material that has a high specific gravity and allows no magnetic flux from the rotor to pass therethrough (low magnetic permeability), and brass is typically used. The brass is, however, expensive and it is desirable not to use the brass to reduce costs.

The conventional technique described in Patent Literature 1 includes a through-opening, which is unbalanced with respect to the shaft hole as the center, in at least one axial end. This through-opening is provided in an orientation to cancel deformation in a crankshaft caused when the refrigerant is compressed. With such a configuration, a similar effect to the case with the balance weights 9 can be expected. The configuration of the conventional technique, however, is problematic in that its effect of cancelling the vibration is small and it cannot reduce costs and produce the vibration mitigating effect at a similar level to the case with the balance weights.

In the hermetic rotary compressor according to the present embodiment, the upper large-diameter inner circumferential portion 5*a* and the lower large-diameter inner circumferential portion 5*b* have the inner diameters larger than the inner diameter of the small-diameter portion inner circumferential portion 6, with their centers 11 offset with respect to the rotation axis line 10 in the radial direction. Additionally, the gas venting hole 2*a* is formed such that it communicates with the passageway 14 in the crankshaft 2. The discharge openings 2*e* of the gas venting hole 2*a* are provided at the positions facing the inner circumferential surface 4*b* of the lower large-diameter inner circumferential portion 5*b* of the rotor 1, in the direction in which the lower large-diameter inner circumferential portion 5*b* is offset and in the direction opposite to the offset. Thus, as the refrigerant and the like under the influence of the centrifugal force of the crankshaft 2 hits the inner circumferential surface 4*b* (particularly, the surface on the clearance W2 side illustrated in FIG. 7) of the lower large-diameter inner circumferential portion 5*b*, its jetting force acts as a force to decenter the crankshaft 2. As a result, the vibration mitigating effect at a similar level to the case with the balance weights 9 can be obtained without the balance weights 9.

Figure 8:
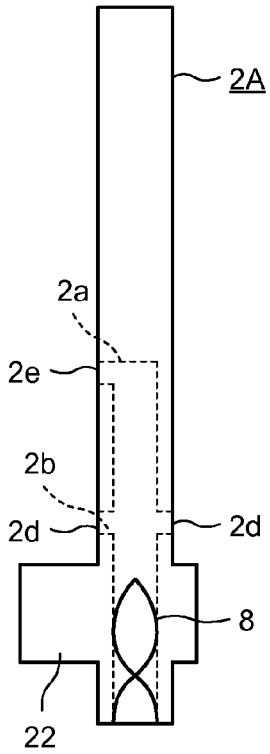
FIG. 8 is a diagram of an exemplary modification of the crankshaft according to the first embodiment of the present invention.

FIG. 8 is a diagram of an exemplary modification of the crankshaft according to the first embodiment of the present invention. In FIG. 8, the exemplary modification of the crankshaft according to the present embodiment is illustrated. A crankshaft 2A illustrated in FIG. 8 has a gas venting hole 2*a* having one discharge opening 2*e*. In other words, the gas venting hole 2*a* illustrated in FIG. 8 is formed such that it communicates with a passageway 14 but does not penetrate through the crankshaft 2A. The discharge opening 2*e* is provided at a position facing the inner circumferential surface 4*b* of the lower large-diameter inner circumferential portion 5*b* of the rotor 1 in the direction opposite to the direction in which the lower large-diameter inner circumferential portion 5*b* is offset. That is, the discharge opening 2*e* is provided at the clearance W2 side illustrated in FIG. 7. In the case of such a configuration, since the refrigerant and the like under influence of the centrifugal force of the crankshaft 2A is discharged from the one discharge opening 2*e*, its jetting force is increased in comparison with the case with the two discharge openings 2*e* and the force to decenter the crankshaft 2A can be further increased.

As described above, a hermetic rotary compressor according to the present embodiment includes: a compression unit 20 that compresses refrigerant gas; an electric motor that drives the compression unit 20; a hermetic container that accommodates the compression unit 20 and the electric motor and contains the refrigerant; and a crankshaft 2 that extends from the compression unit 20 to the electric motor and is provided on a rotor 1 in the electric motor. The rotor 1 has two large-diameter inner circumferential portions (5*a* and 5*b*) formed at its two axis end portions (1*b* and 1*c*), the large-diameter inner circumferential portions (5*a* and 5*b*) have inner diameters larger than an inner diameter of an axially middle portion (1*d*) of the rotor 1 and have inner diameter centers 11 offset with respect to a rotation axis line 10 of the crankshaft 2 in a radial direction. The crankshaft 2 has a first passageway (14), which is formed in the crankshaft 2 and allows the refrigerant to flow therethrough, and a second passageway (2*a*), which provides communication between the first passageway and discharge openings 2*e* formed in an outer circumferential surface 2*c* of the crankshaft 2. The discharge openings 2*e* are formed at positions facing an inner circumferential surface 4*b* of one large-diameter inner circumferential portion (5*b*) of the two large-diameter inner circumferential portions (5*a* and 5*b*), the one large-diameter inner circumferential portion (5*b*) is on the compression unit 20 side. This configuration enables the jetting force of the refrigerant discharged from the discharge openings 2*e* to act as a force to decenter the crankshaft 2. As a result, the vibration mitigating effect at a similar level to the case with the balance weights 9 can be obtained without the balance weights 9; thus, costs can be reduced and the vibrations and noises can be mitigated.

Additionally, in the hermetic rotary compressor according to the present embodiment, the second passageway (2*a*) is in communication with the first passageway (14) and penetrates through the crankshaft 2 in the radial direction, with the discharge openings 2*e* provided in the direction in which the one large-diameter inner circumferential portion (5*b*) is offset and in the opposite direction. With such a configuration, the jetting force of the refrigerant discharged from the discharge openings 2*e* can be used as a force to cancel the deforming force of the crankshaft 2 in the most effective manner.

Second Embodiment

Figure 11:
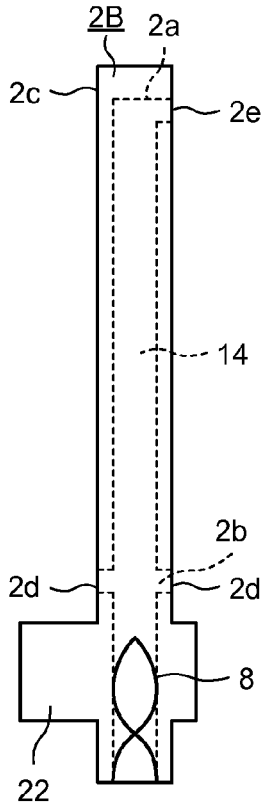
FIG. 11 is a configuration diagram of a crankshaft included in a hermetic rotary compressor according to a second embodiment of the present invention.
Figure 12:
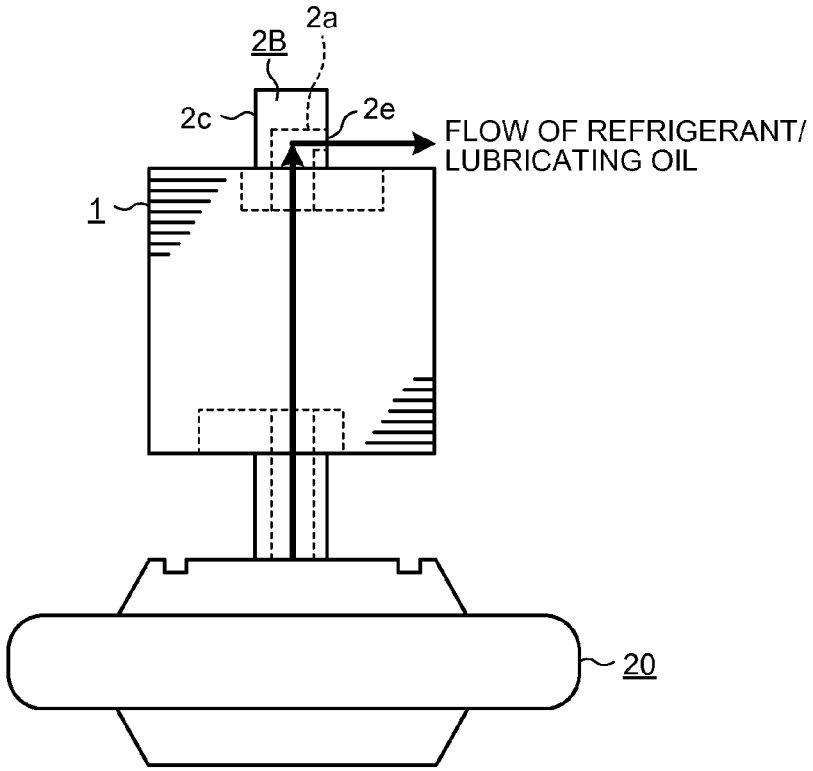
FIG. 12 is a diagram for explaining the operation of the hermetic rotary compressor according to the second embodiment of the present invention.

FIG. 11 is a configuration diagram of a crankshaft included in a hermetic rotary compressor according to a second embodiment of the present invention. FIG. 12 is a diagram for explaining the operation of the hermetic rotary compressor according to the second embodiment of the present invention. The difference from the first embodiment is a crankshaft 2B included instead of the crankshaft 2 or 2A. The crankshaft 2B has a gas venting hole 2*a* and an oil supply hole 2*b* formed therein similarly as in the first embodiment, but a discharge opening 2*e* of the gas venting hole 2*a* is positioned above the upper end surface of the rotor 1. As illustrated in FIG. 12, the gas venting hole 2*a* does not penetrate through the crankshaft 2B and the discharge opening 2*e* is provided in the direction opposite to the direction in which a lower large-diameter inner circumferential portion 5*b* is offset.

The operation of the hermetic rotary compressor according to the second embodiment will now be described. When the refrigerant and the like flowing through the passageway 14 is discharged from the discharge opening 2*e* of the gas venting hole 2*a*, a centrifugal force due to the rotation of the crankshaft 2B acts on the refrigerant and the like. As described above, the discharge opening 2*e* of the gas venting hole 2*a* is positioned above the upper end surface of the rotor 1. Hence, the decentering force due to the jetting of the refrigerant and the like discharged from the discharge opening 2*e* is generated at a position relatively far away from a compression unit 20. Thus, a vibration mitigating effect of the hermetic rotary compressor according to the second embodiment can be expected to be larger than that of the first embodiment.

If the discharge opening 2*e* of the gas venting hole 2*a* is formed at a position facing the inner circumferential surface of an upper large-diameter inner circumferential portion 5*a*, the lubricating oil would be accumulated in an inner circumferential portion of the rotor 1. Thus, the discharge opening 2*e* of the gas venting hole 2*a* according to the present embodiment is positioned above the upper end surface of the rotor 1. Additionally, an end plate may be provided on the rotor 1 such that it covers the opening of the upper large-diameter inner circumferential portion 5*a* to prevent the collecting of the lubricating oil discharged from the gas venting hole 2*a* in the upper large-diameter inner circumferential portion 5*a*.

The hermetic rotary compressor according to the embodiments of the present invention is presented as examples of the present invention; it is possible to combine the hermetic rotary compressor with yet another publicly known technique, and it is of course also possible to configure the hermetic rotary compressor with a modification, such as a partial omission, without departing from the spirit of the present invention.

INDUSTRIAL APPLICABILITY

As described above, the present invention can be applied to hermetic rotary compressors and is particularly useful in reducing costs and mitigating vibration.

The invention claimed is:

1. A hermetic rotary compressor, comprising:

an electric motor that drives a compression unit configured to compress refrigerant gas;

a hermetic container that accommodates the compression unit and the electric motor and contains the refrigerant gas; and a crankshaft that extends from the compression unit to the electric motor and is provided on a rotor in the electric motor, wherein the rotor has two large-diameter inner circumferential portions formed at two axis end portions of the rotor, the large-diameter inner circumferential portions include an upper large-diameter inner circumferential portion and a lower large-diameter inner circumferential portion having inner diameters larger than an inner diameter of an axially middle portion of the rotor, the large-diameter inner circumferential portions have inner diameter centers offset with respect to a rotation axis line of the crankshaft in a radial direction, the crankshaft has a first passageway and a second passageway, the first passageway being formed in the crankshaft and allowing the refrigerant gas to flow through the first passageway, the second passageway providing communication between the first passageway and at least one discharge opening that is formed in an outer circumferential surface of the crankshaft, the at least one discharge opening jets out the refrigerant gas onto an inner circumferential surface of one of the two large-diameter inner circumferential portions and is formed at a position that faces the inner circumferential surface of the one of the two large-diameter inner circumferential portions, the one of the two large-diameter inner circumferential portions is the lower large-diameter inner circumferential portion provided on a side of the compression unit, the second passageway is in communication with the first passageway and penetrates through the crankshaft in the radial direction, and the at least one discharge opening comprises two openings that are provided in a direction in which the one large-diameter inner circumferential portion is offset and in a direction opposite to the direction in which the one large-diameter inner circumferential portion is offset.

2. A hermetic rotary compressor, comprising:

an electric motor that drives a compression unit configured to compress refrigerant gas;

a hermetic container that accommodates the compression unit and the electric motor and contains the refrigerant gas; and a crankshaft that extends from the compression unit to the electric motor and is provided on a rotor in the electric motor, wherein the rotor has two large-diameter inner circumferential portions formed at two axis end portions of the rotor, the large-diameter inner circumferential portions include an upper large-diameter inner circumferential portion and a lower large-diameter inner circumferential portion having inner diameters larger than an inner diameter of an axially middle portion of the rotor, the large-diameter inner circumferential portions have inner diameter centers offset with respect to a rotation axis line of the crankshaft in a radial direction, the crankshaft has a first passageway and a second passageway, the first passageway being formed in the crankshaft and allowing the refrigerant gas to flow through the first passageway, the second passageway providing communication between the first passageway and at least one discharge opening that is formed in an outer circumferential surface of the crankshaft, the at least one discharge opening jets out the refrigerant gas onto an inner circumferential surface of one of the two large-diameter inner circumferential portions and is formed at a position that faces the inner circumferential surface of the one of the two large-diameter inner circumferential portions, the one of the two large-diameter inner circumferential portions is the lower large-diameter inner circumferential portion provided on a side of the compression unit, and the at least one discharge opening comprises one opening that is provided in a direction opposite to a direction in which the one large-diameter inner circumferential portion is offset.

3. A hermetic rotary compressor, comprising:

an electric motor that drives a compression unit configured to compress refrigerant gas;

a hermetic container that accommodates the compression unit and the electric motor and contains the refrigerant gas; and a crankshaft that extends from the compression unit to the electric motor and is provided on a rotor in the electric motor, wherein the rotor has two large-diameter inner circumferential portions formed at two axis end portions of the rotor, the large-diameter inner circumferential portions include an upper large-diameter inner circumferential portion and a lower large-diameter inner circumferential portion having inner diameters larger than an inner diameter of an axially middle portion of the rotor, the large-diameter inner circumferential portions have inner diameter centers offset with respect to a rotation axis line of the crankshaft in a radial direction, the crankshaft has a first passageway and a second passageway, the first passageway being formed in the crankshaft and allowing the refrigerant gas to flow through the first passageway, the second passageway providing communication between the first passageway and at least one discharge opening that is formed in an outer circumferential surface of the crankshaft, the at least one discharge opening is formed above an upper end surface of the rotor on an opposite side of the rotor from the compression unit, and the at least one discharge opening is provided in a direction opposite to a direction in which one of the large-diameter inner circumferential portions as the lower large-diameter inner circumferential portion provided on a side of the compression unit is offset.

* * * * *